United States Patent [19]

Ohara et al.

[11] Patent Number: 4,880,557

[45] Date of Patent: Nov. 14, 1989

[54] SPRAY LUSTERING-CLEANSING AGENT

[75] Inventors: Sosaburo Ohara, Tokyo; Atsushi Ikeda, Fujisawa; Seigo Shinohara, Chigasaki; Tetsuo Kijima, Fujisawa, all of Japan

[73] Assignee: Taiho Industries Co., Ltd., Tokyo, Japan

[21] Appl. No.: 180,182

[22] Filed: Apr. 11, 1988

Related U.S. Application Data

[63] Continuation-in-part of Ser. No. 33,352, Apr. 2, 1987, abandoned.

[30] Foreign Application Priority Data

Aug. 21, 1986 [JP] Japan ..... 61-194038

[51] Int. Cl.[4] ..... C11D 7/22

[52] U.S. Cl. ..... 252/174.15; 106/3; 134/40

[58] Field of Search ..... 134/40; 252/174.15; 106/3

[56] References Cited

U.S. PATENT DOCUMENTS

| | | | |
|---|---|---|---|
| 4,010,110 | 3/1977 | Cosentino et al. | 252/174.15 |
| 4,269,739 | 5/1981 | Grejsner | 252/174.15 |
| 4,374,745 | 2/1983 | Fibley et al. | 252/174.15 |
| 4,511,489 | 4/1985 | Requejo et al. | 252/174.15 |
| 4,675,125 | 6/1987 | Sturwold | 252/174.15 |

OTHER PUBLICATIONS

Ash "A Formulary of Detergents and Other Cleansing Agents" (1980) pp. 176–177, 1980–187, 192–197.

Chalmers "Domestie and Industrial Chemical Specialties" pp. 162–165 (1966).

*Primary Examiner*—Asok Pal

*Attorney, Agent, or Firm*—Oblon, Spivak, McClelland, Maier & Neustadt

[57] ABSTRACT

A spray lustering-cleansing agent is produced by preparing a basic material substantially comprising 5.0 to 60 wt % of silicone oil obtained by emulsifying silicone oil with water in the presence of an emulsifier, 0.1 to 10.0 wt % of an emulsifier, and water and charging a spray can with the basic material in combination with a foam regulating agent and a propellant. A single spray is enough for the lustering-cleansing agent to clean a dirty tire and, at the same time, impart luster to the surface. Additional incorporation of a water-soluble organic base in the agent enables this agent to manifest an improved foaming property and consequently an improved lustering-cleansing effect.

3 Claims, No Drawings

SPRAY LUSTERING-CLEANSING AGENT

CROSS REFERENCE TO RELATED APPLICATION

This is a continuation-in-part application of patent application Ser. No. 033,352 filed Apr. 2, 1987 abandoned.

BACKGROUND OF THE INVENTION

Field of the Invention and Related Art Statement

This invention relates to a novel spray lustering-cleansing agent. More particularly this invention relates to a sspray lustering-cleansing agent which is applied by spraying on dirty rubber and plastic parts of tires and bumpers of an automobile and left to foam and defoam spontaneously thereon and consequently purging their surfaces of dirt and imparting luster thereon in one step.

Generally, cleansing of dirty tires and bumpers of an automobile is carried out by first brushing and wetting the dirty surfaces, then washing the resulting dirty slurry off the surfaces, subsequently spraying a spray type lustering agent on the freshly cleaned surfaces, and wiping the deposited lustering agent from the surfaces as with rags for finishing.

This method, owing to the action of brushing involved, has the disadvanatage that it may mar aluminum wheels and the paint etc. of the bumper.

The spray type lustering-cleansing agents heretofore known to the art are those of the solvent type produced by dissolving silicone oil in petroleum type solvents and chlorine type solvents and those of the o/w emulsion type produced by emulsifying silicone oil with water.

Among the spray lustering-cleansing agents mentioned above, those of the solvent type have the merit of quickly drying and, on the other hand, suffer from the disadvantage that some, if not all, of the solvents used therein disolve out components of the bumper paint finish and swell and discolor the rubber in the tires, and consequently have adverse effects on rubber and paint coatings.

The spray lustering-cleansing agents of the aforementioned solvent type, because of their use of volatile solvents, also have the disadvantage that they have harmful effects on the health of the workers handling them.

The spray lustering-cleansing agents of the o/w emulsion type are free from the disadvantage of adverse effects on rubber and coatings, but they suffer from the disadvanatage that foamed agents deposited on the surfce do not easily vanish and must be wiped off with rags for finishing and, therefore, the cleansing work is strenuous.

U.S. Pat. No. 4,010,110 discloses a composition as a cleansing agent. This agent does not foam from the beginning. Pat. No. 4,269,739 pertains to a composition as a cleansing agent. It make no mention about the condition of foaming and defoaming which this composition would manifest it it were prepared in the form of an aerosol spray. Pat. No. 4,374,745 teaches a composition as a cleansing agent. It makes no mention about the condition of foam which the composition would manifest if it were prepared as an aerosol spray. The composition in the form of gel or in a thixotropic state does not foam after the manner of an aerosol. Pat. No. 4,675,125 is directed to a composition as a cleansing agent. The cleansing agent uses a defoaming agent for the purpose of preventing foaming which is undesirable during the manufacture and use when the composition. All of these U.S. patents are silent on the foam which would be generated if the composition should be prepared in the form of an aerosol spray. It can be presumed, therefore, that these four U.S. patents contemplate adding a foam regulating agent purely for the purpose of preventing the composition from foaming. None of them suggests, let alone discloses, the use of a foam regulating agent for the purpose of allowing the composition to remain in a foamed state for a period of 10 to 20 seconds and then defoam completely within one minute of generating foam as in the case of the present invention.

OBJECT AND SUMMARY OF THE INVENTION

In the circumstances, a need has arisen for the development of a cleansing method which, by simple spraying, cleanses and lusters a surface throuhly without injuring the surface, dissolving paint coatings, or exerting any adverse effect on the health of the worker. A cleansing agent for use with such a method has also become necessary.

The present invention has been perfected for the purpose of meeting this method. To be specific, this invention is directed to a spray lustering-cleansing agent which comprises a water-based material containing silicone oil in the form of an emulsion, and a propellant added to the water-based material and a foam regualtion agent.

The method of using the spray lustering-cleansing agent is characterized by the steps of spraying on a dirty surface a lustering-cleansing agent comprising a water-basaed material containing silicone oil in the form of an emulsion and a propellant and a foam regulation agent, thereby allowing the lustering-cleansing agent to be deposited in a foamed state on the surface, the rupturing the foamed agent for thereby converting the foam into a liquid and enabling the liquid to occlude the dirt adhering to the surface, and subsequently removing the liquid from the surface.

DETAILED DESCRIPTION OF THE PREFERRED EMBODIMENT

The term "basic material" as used in the present invention refers to a sislicone oil-water emulsion obtained by use of an emulsifier.

The term "silicone oil" as used herein means a silicone oil of the type having the ability to luster surfaces. Examples of the silicone oil meeting this description include dimethyl silicone oil, phenyl methyl silicone oil, amino-modified silicone oil, epoxy-modified silicone oil, and fatty acid-modified silicon oil.

The basic material mentioned above can be obtained by adding to the sislicone oil and emulsifier such as morpholine oleate soap, oleic acid triethanol amine soap, oleic acid or stearic acid and morpholine or triethano amine, sodium oleate, sodium alkylbenzene-sulfonate, pol.yoxyethylene alkylphenol ether, polyoxyethylen alkyl ether, or polyoxyethylene fatty acid ester, optionally adding there, when necessary for ensuring stable emulsification and removal of greasy dirt, a petroleum type solvent such as kerosene, mineral spirit, normal paraffin type solvent, or isoparaffin type solvent, and optionally further adding thereto, when necessary for preventing deterioration, improving the leveling property relative to a surface to be cleansed, and ensuring lasting retention of luster of deep shade, a polyhydric alcohol such as ethylene glycol, propylene glycol, or triethylene glycol and then emulsifying the resultant silicone oil composite in water.

The silicone oil content in the substrate is in the range of 5 to 60% by weight, preferably 10 to 20% by weight. If the amount of the silicone oil is smaller, the produced cleansing-lustering agent is deficient in waterproofness, water-repellency, and lustering property and fails to fulfil the function thereof. If the amount is larger, the produced agent lacks homogeneity, takes on a garish, unpleasant shine and tends to gather dust, dirt, and mud because of its stickiness.

The emulsion is necessary for emulsification and the solvent for stabilization of the emulsion and for removal of greasy dirt. The emulsifier content in the basic material must be in the range of 0.5 to 10.0% by weight, preferably 1.0 to 5.0% by weight and the solvent content therein in the range of 0.5 to 30% by weight, preferably 0.5 to 10% by weight.

The lustering-cleansing agent of the present invention has its effect improved by incorporation of a foam regulating agent in the basic material thereof. As the foam regulating agent, there may be used a surfactant such as, for example, polyoxyalkylene glycol alkyl ether, polyoxyalkylene glycol alkyl ester, or polyoxyethylene-polyoxypropylene block copolymer. The amount of the foam regulating agent to be incorporated in the basic material is in the range of 0.1 to 5.0% by weight, preferably 0.5 to 3.0% by weight, as effective component based on the amount of the basic material. As the emulsion type, what is obtained by emulsifying silicone oil, higher alcohol, hydrogenatedd beef tallow, or wax with waater using an emulsifier can be used. The amount of the emulsion otype to be used is in the range of 0.01 to 2.0% by weight, preferably 0.05 to 1.5% by weight, as effective component based on the weight of the basic material. As the oil slurry type, a slurry obtained by dissolving wax such as amide wax or polyethylene wax in mineral oil can be used. The amount of the oil slurry type to be used is in the range of 0.01 to 2.0% by weight, preferably 0.05 to 1.5% by weight, as effective component based on the amount of the basic material. As the alcohol type there can be used any of the alcohols ranging from methanol of one carbon atom to dodecanol of 12 carbon atoms ($C_nH_{2n+1}OH$; 1 to 12). The amount of the alcohol type to be used is in the range of 0.5 to 20.0% by weight, preferably 1.0 to 10.0% by weight, based on the amount of the basic material. One member or a suitable combination of two or more members selected from the various foam regulating agents cited above can be used. If the foam regulating agent is used in an amount exceeding the upper limit of the range specified above, the produced lustering cleansing agent does not easily foam when applied by spraying on a surface and, therefore, fails to fulfil the function thereof.

By the addition of at least one member selected from the group consisting of nonionic surfactants and anionic surfactants each possessing an HLB value exceeding 10 to the lustering-cleansing agent, the emulsion released by spraying from the container is enabled to gain in instability. The amount of the surfactanat to be added is in the range of 0.2 to 10.0% by weight, preferably 0.5 to 5.0% by weight, based on the amount of the basic material.

When the lustering-cleansing agent containing no surfactant is released by spraying from the container, the emulsion does not defoam easily because of persisting stability even after the propellant has been completely gasified. When the lustering-cleansing agent which has incorporated therein the surfactant to enhance the instability of emulsion is sprayed, the agent is allowed to retain the foamed state until the propellant in the foam is completely gasified. After the propellant has been gasified, the emulsion defoams because it is so instable as to be readily ruptured.

For the lustering-cleansing agent to produce a foam capable of adhering fast to the surface of a tire, for example, after release by spraying from the container, it is required to possess a pH value in the range of 8 to 11, optimally 8 to 10. For pH adjustment of this agent, it is proper to use a water-soluble organic base. As examples of the water-soluble organic base, there can be cited such powdery compounds as sodium benzoate, sodium citrate, sodium malate, and ammonium benzote and such alkanol amines as triethanol amine and diethanol amine. The amount of the organic base to be used is in the range of 0.05 to 2.0% by weight, based on the weight of the lustering-cleansing agent. Such a strongly basic substance as sodium hydroxide or potassium hydroxide can affect rubber and coating material.

Since the lustering-cleansing agent is used by spraying, a propellant such as, for example, liquefied petroleum gas, dimethyl ether, $N_2$ gas, $CO_2$ gas, or florinated hydrocarbon gas is charged in a spray can in an amount such that the ratio of the propellant to the lustering-cleansing agent falls in the range of 30 : 70 to 5 : 95 by weight. One member or a suitable combination of two or more members selected from the group or propellants mentioned above can be used.

With the lustering-cleansing agent of this invention, a given surface is treated as follows. For cleaning tires and bumpers of an automobile, for example, the lustering-cleansing agent is sprayed onto the surfaces and allowed to be deposited in a foamed state on the surfaces and then left standing for a fixed length such as, for example, a period in the range of 10 to 20 seconds and then left to defoam spontaneously within 1 minute of being sprayed. During this standing period, the applied foamed agent spontaneously converts into a liquid occluding the dirt from the surfaces. By allowing this liquid to run off, the tires and the bumpers are cleansed.

It is thought that this cleansing proceeds through the following mechanism. (a) When the lustering-cleansing agent is sprayed in a foamed state on a surface, the foam occludes dust, mud, and other defiling substances adhering to the surface and clings to the surface. In the course of this clinging, the cleansing component of the lustering-clensing agent permeates the dirt and weakens the strength with which the dirt adheres to the surface. (b) The dirt which has partly lost its strength of adhesion is separated from the surface when the foam is converted through rupture into the liquid by the action of the foam regulation agent contained in the lustering-cleansing agent. (c) The dirt which has thus been separated from the surface is made to flow down together with the liquid resulting from the ruptured foam.

This invention accomplishes the cleansing and lustering of the tires and bumpers of an automobile, for example, in the manner described above. The spray lustering-cleansing agent of this invention is an o/w type preparation having a silicone oil emulsified in water. When it is used in cleansing tires or bumpers, for example, it brings about no such adverse effect as swelling the rubber or dissolving out paint and, unlike the conventional cleansing agents of the solvent type, has no harmful effect on the human body. It is thus safe to use.

Further, when tires or bumpers are treated with the lustering-cleansing agent of this invention, since the cleaned surface is lustered by being coated with the silicone oil and, at the same time, conferred hydrophobicity, the liquid which has resulted from rupture of foam and has occluded the dirt is allowed to flow down smoothly and quickly.

Further in the present invention, since the waterbased material containing the silicon oil in the form of emulsion further incorporates therein a suitable amount of a foam regulation agent, the produced foam is enabled to adhere to the surface for a proper time, convert itself into a liquid and, as such, flow down the surface in conjunction with the dirt adhering to the surface. During the rupture, the foam liberates the silicone so far retained in the form of emulsion and deposits it fast on the surface of tires or bumpers, with the result that the deposited silicone lusters the surface.

The term "proper time" as used herein means such time as is required for the dirt to float up and flow down the surface. A span in the range of 20 seconds to 5 minutes suffices. This span is desirably in the range of 2 to 60 seconds.

In accordance with this invention, therefore, tires and bumpers can be cleaned and lustered without particularly requiring the work of wiping. In this respect, this invention contributes to improving the efficiency of the work of cleansing.

Now, the present invention will be described more specifically below with reference to working examples.

First, lustering-cleansing agents according to the present invention and cleansing agents not conforming to the present invention and intended for comparison were prepared.

The preparation of a lustering-cleansing agent of this invention was carried out specifically by stirring a silicone oil with an emulsifier and a polyhydric alcohol and, when necessary, subjecting the resulting mixture and a foam regulation agent added thereto to high-speed stirring until homogeneity, adding a small portion of the water required for emulsification to the homogeneous mixture thereby forming a pre-gel, and emulsifying this pre-gel in the presence of the remaining portion of the water with an emulsifying machine. As a result, there was obtained a lustering-cleansing agent of this invention which comprised a water-based material containing silicone oil in the form of an emulsion, a propellant added to the water-based material, and a foam regulation agent further added thereto. A cleansing agent consisting of different components than those according to the invention was also prepared for comparison.

Then, these agents were each combined with a propellant and charged in a spray can and (except for Comparative Example 4) sprayed onto a surface to be subjected to cleansing. The liquids formed on the surfaces were left to flow off. At this time the agents were evaluated with regard to the vaarious qualities indicated below. The results were as shown in Table.

Method of Evaluation

1. Leveling property:

A sample tire was sprayed with a given agent for 3 seconds. The surface condition of the sample tire was visually observed with respect to the leveling property of the agent. The surface condition so observed was rated on a three-point scale, wherein:

o: The surface condition of the tire was substantially uniform.

Δ: The surface condition of the tire was succh that slight signs of streaks, wrinkles, and irregularities appearedd.

x: The surface condition of tire was such that signs of irregularities existed in not less than half of the entire surface.

2. Wiping property:

A same tire was sprayed with a given agent for 3 seconds. Then the applied agent was tested for working property. The results of the wiping property consequently determined was rated on a three-point scale, wherein:

o: Absolutely no wiping was required.

Δ: Slight wiping was required.

x: Strong wiping was required.

3. Effects on rubber:

An SBR rubber sample (50×50 mm) suspended vertically was sprayed with a given agent from a spray can held at a distance of 2 cm from the sample. The agent thus deposited on the sample, without being wiped off, was left standing at room temperature for 24 hours. After the standing period, the sample was visually observed with respect to the surface condition. The results were rated on a three-point scale, wherein:

o: No abnormality was present.

Δ: Signs of discoloration with slight tarnishing was detected.

x: Signs of swelling and discoloration were detected.

4. Foaming property and foam-removing property:

A sample tire was sprayed with a given agent for 3 seconds. The foam consequently formed was observed visually for its condition, immediately after formation and after one minute's sanding. The results were rated on a four-point scale, wherein:

◎ : The foam initially produced to the fullest extent was completely absent after one minute's standing.

o: The foam initially produced to a great extent was completely absent after one minute's standing.

Δ: The foam initially produced slightly remained after one minute's standing.

$x_1$: No foam was produced initially.

$x_2$: The foam initially produced remained intact even after one minute's standing.

5. Odor:

A sample tire was sprayed with a given agent. During the spraying, the smell of the ambient air was examined for the presence of odor emitted from the tire surface. The results were evaluated on a three-point scale, wherein:

o: No odor was present.

Δ: Slight odor was present.

x: Distinct odor was present.

6. Cleansing property:

A sample tire was sprayed with a given agent for 3 seconds and the foam consequently produced was kept under visual observation to determine whether or not it occluded dirt and then flowed down the surface. The results were evaluated on a three-point scale, wherein:

o: The foam occluded the dirt and flowed down the surface smoothly.

Δ: The foam slightly occluded the dirt and flowed down the surface.

x: The foam failed to occlude the dirt and sparingly flowed down the surface.

The compositions used for the lustering-cleansing agents according to this invention and the cleansing agents not conforming to this invention were as shown below.

EXAMPLE 1

(o/w emulsion type)

| | |
|---|---|
| Dimethyl silicone oil (1,000 cst) | 20.0% by weight |
| POE (9) nonyl phenyl ether (produced by Dai-ichi Kogyo Seiyaku Co., Ltd. and marketed under tradename designation of NOIGEN EA-120; HLB = 12) | 1.5% by weight |
| POE (6) nonyl phenyl ether (produced by Dai-ichi Kogyo Seiyaku Co., Ltd. and marketed under tradename designation of NOIGEN EA-80; HLB = 10) | 2.0% by weight |
| Ethylene glycol | 2.5% by weight |
| Silicone emulsion type foam regulation agent containing 25% by weight of principal component | 0.4% by weight |
| Water | 58.6% by weight |
| Propellant (liquefied petroleum gas) | 15.0% by weight |
| | 100.0 |

EXAMPLE 2

(o/w emulsion type)

| | |
|---|---|
| Dimethyl silicone oil (1,000 cst) | 20.0% by weight |
| Sodium oleate (produced by Nippon Oils & Fats Co., Ltd. and marketed under tradename designation of NONSAL ON-1) | 2.5% by weight |
| Ethylene glycol | 2.5% by weight |
| Polyoxyalkylene glycol ester (foam regulation agent) | 0.4% by weight |
| Water | 59.6% by weight |
| Propellant (liquefied petroleum gas) | 15.0% by weight |
| | 100.0 |

EXAMPLE 3

(o/w emulsion type)

| | |
|---|---|
| Dimethyl silicone oil (1,000 cst) | 20.0% by weight |
| POE (20) sorbitan monooleate (produced by Nikko Chemicals Co., Ltd. and marketed under tradename designation of NIKKOL TO-10; HLB = 15.0) | 1.0% by weight |
| POE (6) monooleate (produced by Nikko Chemicals Co., Ltd. and marketed under tradename designation of NIKKOL MYD-6; HLB = 8.5) | 2.5% by weight |
| Propylene glycol | 2.5% by weight |
| Foam regulation agent prepared in the form of slurry by dispersing 5% by weight of amide wax in mineral oil | 0.4% by weight |
| Water | 58.6% by weight |
| Propellant (liquefied petroleum gas) | 15.0% by weight |
| | 100.0 |

EXAMPLE 4

(o/w emulsion type)

| | |
|---|---|
| Dimethyl silicone oil (1,000 cst) | 15.0% by weight |
| Dimethyl silicone oil (10,000 cst) | 5.0% by weight |
| Oleic acid | 2.5% by weight |
| morpholin | 1.5% by weight |
| Triethylene glycol | 2.5% by weight |
| Isoparaffin type solvent (boiling point ranging from 160° to 200° C.) (produced by Idemitsu Petrochemical Co., Ltd. and marketed under Product Code of IP-1620) | 5.0% by weight |
| Polyoxyalkylene glycol alkyl ester | 1.5% by weight |
| Water | 62.0% by weight |
| Propellant (liquefied petroleum gas) | 5.0% by weight |

-continued

| | |
|---|---|
| | 100.0 |

EXAMPLE 5

(o/w emulsion type)

| | |
|---|---|
| Dimethyl silicone oil (1,000 cst) | 15.0% by weight |
| Amino-modified silicone oil (produced by Toray Silicone Co., Ltd. and marketed under Product Code of SF-8417) | 5.0% by weight |
| POE (20) cetyl ether (produced by Nikko Chemicals Co., Ltd. and marketed under tradename designation of NIKKOL BC-20TX; HLB = 17.0) | 1.0% by weight |
| POE (2) oleyl ether (produced by Nikko Chemicals Co., Ltd. and marketed under tradename designation of NIKKOL BO-2; HLB = 7.5) | 2.5% by weight |
| Ethylene glycol | 2.5% by weight |
| Paraffin type solvent (boiling point ranging from 185° to 215° C.) (produced Nippon Oil Company, Limited, and marketed under Product Code of ZERO SOLVENT L) | 5.0% by weight |
| Isopropyl alcohol | 1.8% by weight |
| Water | 52.2% by weight |
| Propellant 1 (liquefied petroleum gas) | 13.0% by weight |
| Propellant 2 ($N_2$ gas) | 2.0% by weight |
| | 100.0 |

EXAMPLE 6

(o/w emulsion type)

| | |
|---|---|
| Dimethyl silicone oil (1,000 cst) | 20.0% by weight |
| POE (9) nonyl phenyl ether | 1.5% by weight |
| POE (6) nonyl phenyl ether | 2.0% by weight |
| Ethylene glycol | 2.5% by weight |
| Water | 59.0% by weight |
| Propellant (liquefied petroleum gas) | 15.0% by weight |
| | 100.0 |

EXAMPLE 7

(Emulsion with enhanced instability)

| | |
|---|---|
| Dimethyl silicone oil (1,000 cst) | 15.0% by weight |
| POE (50) hydrogenated castor oil (produced by Nikko Chemicals Co., Ltd. and marketed under tradename designation of NIKKOL HCD-50; HLB = 135) | 4.0% by weight |
| POE (3) castor oil (produced by Nikko Chemicals Co., Ltd. and marketed under tradename designation of NIKKOL CO-3; HLB = 3.0) | 2.0% by weight |
| Sodium dodecylbenzenesulfonate (produced by Dai-ichi Kogyo Seiyaku Co., Ltd. and marketed under tradename designation of NEOGEN R) | 3.0% by weight |
| Water | 66.0% by weight |
| Propellant (4.5 kg/cm$^2$ - LPG) | 10.0% by weight |
| | 100.0 |

EXAMPLE 8

(o/w emulsion type)

| | |
|---|---|
| Dimethyl silicone oil (1,000 cst) | 15.0% by weight |
| Dimethyl silicone oil (10,000 cst) | 5.0% by weight |
| POE (20) sorbitan monooleate | 1.0% by weight |

-continued

| | |
|---|---|
| POE (6) monooleate | 2.5% by weight |
| Propylene glycol | 2.5% by weight |
| Isopropyl alcohol | 1.8% by weight |
| Isoparaffin type solvent | 5.0% by weight |
| Water | 52.2% by weight |
| Propellant (liquefied petroleum gas) | 15.0% by weight |
| | 100.0 |

EXAMPLE 9

(emulsion with adjusted pH)

| | |
|---|---|
| Dimethyl silicone oil (1,000 cst) | 20.0% by weight |
| POE (3) octylphenyl ether (produced by Nikko Chemicals Co., Ltd. and marketed under tradename designation of NIKKOL OP-3; HLB = 6.0) | 1.7% by weight |
| POE (30) octylphenyl ether (produced by Nikko Chemicals Co., Ltd. and marketed under tradename designation of NIKKOL OP-30; HLB = 20.0) | 0.9% by weight |
| Propylene glycol | 1.5% by weight |
| Isoparaffin type solvent (boiling point 160° to 200° C.) | 1.5% by weight |
| Silicone emulsion type foam regulating agent containing 25 wt % of active component | 0.5% by weight |
| Ammonium benzoate | 0.3% by weight |
| Aqua ammonia | 0.05% by weight |
| Water | 58.55% by weight |
| Propellant (liquefied petroleum gas, 40 kg/cm$^2$) | 15.0% by weight |
| | 100.0 |

pH = 9.4

EXAMPLE 10

(emulsion with adjusted pH)

| | |
|---|---|
| Dimethyl silicone oil (1,000 cst) | 5.0% by weight |
| Fatty acid-modified silicone oil (2,500 cst) (carboxyl equivalent 3,500, carboxyl content 1.2%, produced by Toray Silicone Oil Co., Ltd. and marketed under product code of "SF-8418") | 15.0% by weight |
| POE (9) nonylphenyl ether | 1.5% by weight |
| POE (6) nonylphenyl ether | 2.0% by weight |
| Triethylene glycol | 2.5% by weight |
| Normal paraffin type solvent (boiling point 185° to 215° C.) | 1.5% by weight |
| Polyoxyethylene-polyoxypropylene block copolymer (foam regulating agent) | 0.8% by weight |
| Triethanol amine | 0.5% by weight |
| Water | 56.2% by weight |
| Propellant (liquefied petroleum gas) | 15.0% by weight |
| | 100.0 |

pH = 10.2

EXAMPLE 11

(emulsion with adjusted pH)

| | |
|---|---|
| Dimethyl silicone oil (300 cst) | 10.0% by weight |
| Epoxy-modified silicone oil (8,000 cst) (epoxy equivalent 3,000, epoxy content 1.3%, produced by Toray Silicone Oil Co., Ltd. and marketed under product code of "SF-8411") | 10.0% by weight |
| POE (20) sorbitan monooleate | 1.0% by weight |
| POE (6) monooleate | 2.5% by weight |
| Ethylene glycol | 2.5% by weight |
| Foam regulator (slurry of 5 wt % of amide wax in mineral oil) | 1.2% by weight |

-continued

| | |
|---|---|
| Sodium citrate | 0.5% by weight |
| Water | 57.3% by weight |
| Propellant (liquefied petroleum gas) | 15.0% by weight |
| | 100.0 |

pH = 8.5

COMPARATIVE EXPERIMENT 1

(no foam regulating agent contained)

| | |
|---|---|
| Dimethyl silicone oil (1,000 cst) | 20.0% by weight |
| POE (5) oleic acid amide (produced by Nikko Chemicals Co., Ltd. and marketed under tradename designation of NIKKOL TAMDO-5; HLB = 11.0) | 2.5% by weight |
| Water | 62.5% by weight |
| Propellant (liquefied petroleum gas) | 15.0% by weight |
| | 100.0 |

COMPARATIVE EXPERIMENT 2

(solvent type)

| | |
|---|---|
| Dimethyl silicone oil (1,000 cst) | 20.0% by weight |
| 1,1,1-Trichloroethane | 62.5% by weight |
| Triethylene glycol | 2.5% by weight |
| Propellant (liquefied petroleum gas) | 15.0% by weight |
| | 100.0 |

COMPARATIVE EXPERIMENT 3

(w/o emulsion type)

| | |
|---|---|
| Dimethyl silicone oil (3,000 cst) | 15% by weight |
| Paraffin type solvent (boiling point ranging from 160° to 200° C.) | 35% by weight |
| POE (3) nonyl phenol ether | 5% by weight |
| Water | 25% by weight |
| Propellant (liquefied petroleum gas) | 20% by weight |
| | 100.0 |

COMPARATIVE EXPERIMENT 4

(o/w emulsion type propelled by pump)

| | |
|---|---|
| Dimethyl silicone oil (1,000 cst) | 24% by weight |
| POE (6) nonyl phenol ether | 2.4% by weight |
| POE (4) nonyl phenol ether | 1.8% by weight |
| Water | 71.8% by weight |
| | 100.0 |

COMPARATIVE EXPERIMENT 5

(propulsion by pump)*1

| | |
|---|---|
| POE (9) nonylphenyl ether | 20.0% by weight |
| Oleic acid | 5.0% by weight |
| Triethanol amine | 10.0% by weight |
| Ethylene glycol monobutyl ether | 5.0% by weight |
| Silicone type defoaming agent | 0.2% by weight |
| Water | 59.8% by weight |
| | 100.0 |

COMPARATIVE EXPERIMENT 6

(wax+silicone+solvent type) *2

| | |
|---|---|
| Paraffin wax (50° to 52° C.) | 1.8% by weight |
| Dimethyl silicone oil (350 cst) | 6.0% by weight |
| Paraffin type solvent (boiling point 160° to 200° C.) | 72.2% by weight |
| Propellant (liquefied petroleum gas) | 20.0% by weight |
| | 100.0 |

*1U.S. Pat. No. 4,675,125

*2A Formulary of Detergents and Other Cleaning Agent, Polishers and Waxes, No. 12

*1: U.S. Pat. No. 4,675,125 *2: A Formulary of Detergents and Other Cleaning Agent, Polishers and Waxes, No. 12

| | Example | | | | | | | | | | | Comparative Experiment | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 1 | 2 | 3 | 4 | 5 | 6 |
| Leveling property | o | o | o | o | o | o | Δ | o | o | o | o | x | x | Δ | x | x | x |
| Wiping property | o | o | o | o | o | Δ | o | o | o | o | o | x | Δ | Δ | x | Δ | x |
| Effect on rubber | o | o | o | o | o | o | o | Δ | o | Δ | o | o | x | Δ | o | x | x |
| Foaming property and foam removing property | o | o | o | o | o | o | o | o | o | o | o | $x_2$ | $x_1$ | $x_2$ | $x_1$ | $x_1$ | $x_1$ |
| Odor | o | o | o | o | Δ | o | o | o | o | o | o | o | x | o | o | x | x |
| Cleansing property | o | o | o | o | o | o | o | o | o | o | o | x | Δ | x | x | Δ | x |

It is noted from the results given above that the lustering-cleansing agents of Examples 1–11 according to the present invention earned satisfactory marks with respect to substantially all items of the test, whereas the comparative cleansing agent gained poor marks.

What is claimed is:

1. A spray lustering-cleaning agent, prepared by charging a spray can with an emulsified basic material in combination with a propellant and a foam regulating agent, said basic material substantially comprising 5.0 to 60.0 wt. % of a silicone oil emulsified with water using an emulsifier, 0.1 to 10.0 wt. % of an emulsifier, a water-soluble organic base which is at least one member selected from the group consisting of sodium benzoate, sodium citrate, sodium malate, ammonium benzoate, triethanol amine and diethanol amine and which adjusts the pH value of the spray lustering-cleansing agent to within a range of 8.0 to 11.0 and which enables the foam of said lustering-cleansing agent to exhibit improved adhesiveness to a tire, and water.

2. The spray lustering-cleansing agent according to claim 1, wherein the amount of said water-soluble organic base to be used in said emulsion is in the range of 0.05 to 2.0% based on the amount of said emulsified basic material.

3. The spray lustering-cleansing agent according to claim 1, wherein said water-soluble organic base is ammonium benzoate.

* * * * *